United States Patent [19]

Nilsson

[11] 4,144,677

[45] Mar. 20, 1979

[54] OVERRUNNING PROTECTION FOR A GRINDING WHEEL

[75] Inventor: Bengt Nilsson, Lidköping, Sweden

[73] Assignee: Lidköpings Mekaniska Verkstads AB, Lidköping, Sweden

[21] Appl. No.: 788,929

[22] Filed: Apr. 19, 1977

[30] Foreign Application Priority Data

May 13, 1976 [SE] Sweden ..... 7605440

[51] Int. Cl.[2] ..... B24B 47/18

[52] U.S. Cl. ..... 51/134.5 R

[58] Field of Search ..... 51/134.5 R, 109, 72 R

[56] References Cited

U.S. PATENT DOCUMENTS

| | | | |
|---|---|---|---|
| 1,982,483 | 11/1934 | Ritz | 51/134.5 R |
| 2,642,703 | 6/1953 | Flygare | 51/134.5 R |
| 3,129,534 | 4/1964 | Miyabayashi | 51/134.5 R |
| 3,656,262 | 4/1972 | Kikuchi | 51/134.5 R |
| 3,673,741 | 7/1972 | Koide | 51/134.5 R |

*Primary Examiner*—Harold D. Whitehead

*Attorney, Agent, or Firm*—Eugene E. Renz, Jr.

[57] ABSTRACT

Overrunning protection for a grinding machine comprising a grinding wheel mounted in a head stock. The head stock is supported on a frame for movement in a direction toward and away from a work rest for a work piece at one end of the frame and a drive for rotating the grinding wheel. The drive is operable to rotate the grinding wheel at a first angular velocity and a second lower angular velocity. The overrunning protection consists of a blocking member operable between a first position permitting engagement of the drive to rotate the grinding wheel at the first angular velocity and a second position permitting engagement of the drive to rotate the grinding wheel at the lower angular velocity. A first sensor senses the position of the blocking member and a second sensor senses the position of the head stock in relation to the grinding position of the work piece at the work rest. The sensors are operatively connected to the drive to control the same in a predetermined manner so that the drive is actuated only if the first sensor senses the blocking member in the second position or if the first sensor senses the blocking member in the second position or if the second sensor senses the head stock in a predetermined position relative to the work piece.

4 Claims, 4 Drawing Figures

(MOTOR CIRCUIT)

(SIGNAL CIRCUIT)

OVERRUNNING PROTECTION FOR A GRINDING WHEEL

BACKGROUND OF THE INVENTION

The present invention refers to an overrunning protection for a grinding wheel in a grinding machine, in which the grinding wheel is mounted in a grinding headstock, which is movable relative to a machine frame, and which machine incorporates means for driving the grinding wheel at two different angular velocities and an adjustable blocking member, which in a first position will allow engagement of the driving means for driving the grinding wheel at an optional angular velocity, whereas it in a second position will allow engagement of the driving means for driving the grinding wheel at the lower angular velocity only.

In order to obtain a good grinding economy and a good grinding result is it desirable that the peripheral velocity of the grinding wheel can be maintained at such a steady and high level as possible during the grinding operation. As the grinding wheel motor in most cases rotates at a constant angular velocity and the transmission to the grinding wheel will not make possible a continuous variation of the transmission ratio between the motor driving shaft and the grinding wheel spindle, however, the peripheral velocity of the grinding wheel will decrease as the grinding wheel diameter will be reduced due to the grinding wheel wear. In order to maintain the grinding wheel at a high peripheral velocity it is known to have two different transmission ratios in the transmission between the driving shaft of the motor and the grinding wheel spindle, whereby the grinding wheel is driven at a lower angular speed when it is new, and at a higher angular velocity when it has been worn off to a certain diameter.

It must however always be ascertained that the grinding wheel is not driven at a too high peripheral velocity, as too high speed easily may lead to breakdown as the grinding wheel cannot withstand the high centrifugal forces which will result. If the transmission has two different transmission ratios, it should thus be provided with means preventing a new grinding wheel from being driven at the higher angular velocity. Such means are earlier know, e.g. by Swedish patent specification 104.904. In this patent a transmission device is described comprising two step pulleys and a driving belt cooperating therewith. A blocking member is provided in the path of the driving belt, and this blocking member is mechanically connected to a control means, the position of which depends on the grinding wheel diameter, in such a manner that it, as long as the diameter of the grinding wheel exceeds a predetermined value, will prevent engagement of the driving belt on the driving pulleys which will give the highest angular velocity to the grinding wheel.

Such an overrunning protection incorporates a rather large number of parts which are mechanically connected to each other, including i.e. cam profiles and long torsion rods, and it will therefore become bulky and sensitive to external influence and it will furthermore have a rather poor precision as to engagement and disengagement of the blocking member relative to the position of the control means.

SUMMARY OF THE INVENTION

The purpose of the present invention is to provide an overrunning protection for a grinding machine of the type specified in the preamble of claim 1, which by aid of simple and reliable means will give a high blocking precision as to preventing the driving of the grinding wheel at an angular velocity exceeding that one corresponding to the diameter of the grinding wheel.

The features characterizing the invention are specified in the appended claims.

BRIEF DESCRIPTION OF THE DRAWING

An embodiment of the invention will hereinafter be further described with reference to the accompanying drawing, FIG. 1 of which shows one side of a portion of a grinding machine inclusive of the driving means for the grinding wheel and the adjustable blocking means, whereas

DESCRIPTION OF THE PREFERRED EMBODIMENT

Figure 1:
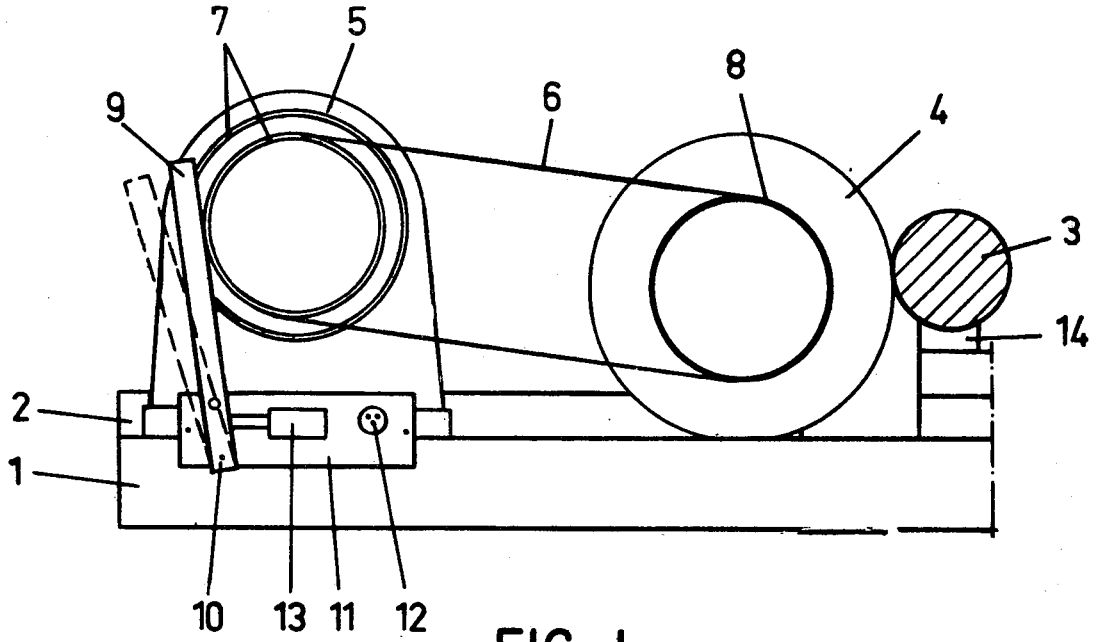

The grinding headstock 2 is displaceably carried in the machine frame 1 in a direction mainly perpendicular to the longitudinal direction of a cylindric work piece 3, which is shown in cross section. The grinding wheel 4 and its driving motor 5 are mounted on the grinding headstock. The grinding wheel is driven via a driving belt 6 and belt pulleys 7, 8 fitted to the motor shaft and the grinding wheel spindle respectively. In order to make possible driving of the grinding wheel at two different angular velocities preferably two belt pulleys of different diameter are arranged on each of the grinding wheel spindle and driving motor shaft as shown at the driving motor in FIG. 1.

The driving belt shall cooperate with the largest belt pulley on the motor shaft for driving the grinding wheel at the higher angular velocity. In the figure is thus shown the position for driving the grinding wheel at the lower angular velocity. Adjacent the driving pulleys of the motor shaft there is arranged an adjustable blocking means designed as a stop lever 9, which can be set at two different positions.

The lever is pivotable about a shaft 10 arranged on an adjustable plate 11. The position of the plate 11 relative to the driving motor shaft and therefore also the distance between the motor shaft and the stop lever 9 can be adjusted by means of a readjustment member 12 in dependency of the desired grinding speed range.

The choice of grinding speed range is carried about by using belt pulleys 7 with suitable diameters, which entails a need for adjustability of the position of the plate 11. A comparatively large belt pulley 7 is used when grinding at high speed, and when grinding at a low speed a comparatively small belt pulley is used, and the space between the stop lever 9 and the driving motor shaft must be adjusted in accordance thereto.

The maximum grinding wheel diameter is delimited by the measures of the grinding machine, and generally only one grinding wheel size is used for each grinding machine. Otherwise the sizes of the belt pulleys must be adapted to different grinding wheel sizes.

The stop lever 9 acts in its inner position, shown with continuous lines in FIG. 1, as a stop which prevents the driving belt from being engaged with the larger one of the pulleys 7. When the stop lever is in its outer position, shown in dashed lines in FIG. 1, the driving belt can be engaged with anyone of the pulleys.

The stop lever is connected to a switch 13, which senses the position of the stop lever. The stop lever acts upon the switch when in its inner position, whereas the switch is not influenced by the stop lever when this is in its outer position. The switch 13 is connected with the driving means of the grinding machine in the manner described herebelow. The work piece 3 rests on a workrest 14, and the position of the grinding headstock 2 on the machine frame is depending at one hand on the diameter of the work piece and on the other hand on the diameter of the grinding wheel.

Figure 2:
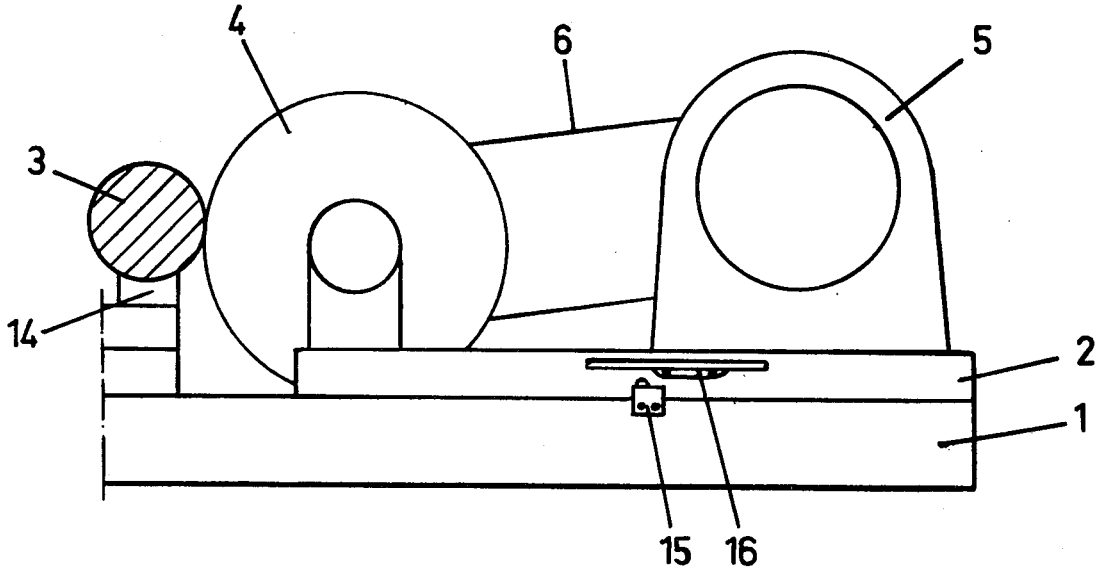
FIG. 2 shows the opposite side of the same portion of the grinding machine including the grinding headstock, a portion of the machine frame and means for sensing the position of the grinding headstock.
Figure 3:
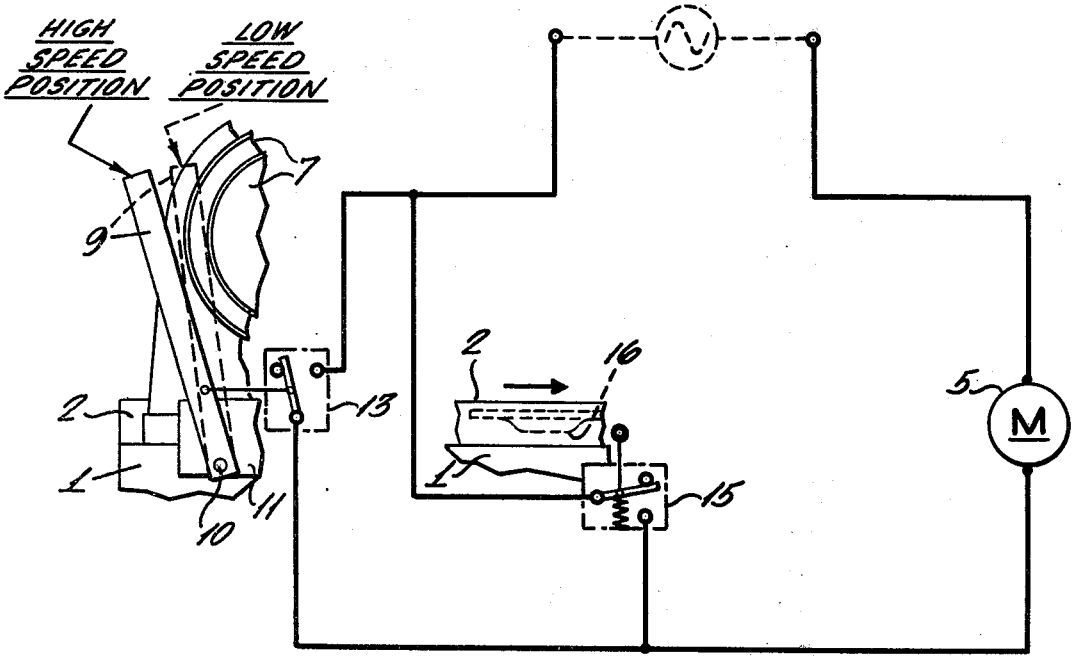
FIGS. 3*a* and 3*b* are schematic showings of the electrical circuitry.
Figure 3A:
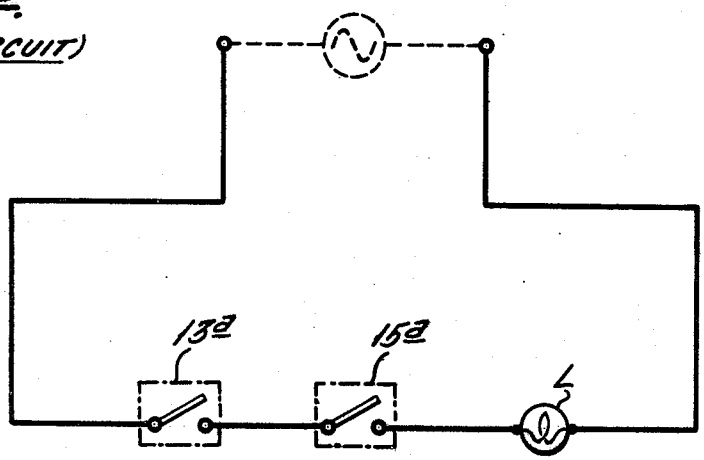

When the grinding wheel is new and/or when the work piece diameter is large the grinding headstock is further away from the workrest 14 during the grinding as compared to the situation when the grinding wheel is worn off and/or when the work piece diameter is small. As shown in FIG. 2 the grinding machine is provided with means designed as a cam switch 15 disposed on the machine frame and a cam strip 16 arranged on the grinding headstock, intended for sensing the position of the grinding headstock in relation to the grinding position of the work piece, i.e. the workrest 14. The cam strip 16 is adjustable in relation to the diameter of the work piece, in such a manner that switch 15 will be acted upon by the strip 16 during the grinding, as soon as the diameter of the grinding wheel has been reduced to a predetermined value, i.e. the value at which the driving belt 6 shall be fitted on the larger one of the pulleys 7 (FIG. 1) in order to give the grinding wheel the desired peripheral velocity. When the grinding wheel is larger and the grinding headstock is moved completely out from the grinding position, the switch 15 is not influenced. This position is shown in the figure. The switch 15, is, alike the switch 13, connected to the driving means of the grinding machine. The connection is such that the grinding machine cannot be started or driven unless one or both of the switches 13 and 15 are acted upon i.e. unless the stop lever 9 takes its position for preventing engagement of the driving belt on the larger one of pulleys 7 or the grinding headstock is within a predetermined largest distance from the position nearest to the grinding position of the work piece or unless both these conditions are fulfilled. In this manner it is ascertained that the grinding wheel cannot be driven at the higher angular velocity until the grinding wheel has been worn off to a predetermined diameter.

In the case where both switches are acted upon it is suitable that a signal is activated, in order to inform that it is possible to change the position of the driving belt 6 from the smaller to the larger belt pulley 7. When this change shall be made is it necessary that the stop lever 9 is moved to its outer position, and the switch 13 is hereby disengaged, which means that said signal terminates.

Other embodiments of the invention than the one shown in the drawing are of course possible. The sensing means 15, 16 may for instance be designed in another manner and they may furthermore for instance be located on the same side of the grinding machines as member 13. The driving mechanism for the grinding wheel does not have to consist of a driving belt and belt pulleys but can instead comprise any variable transmission. The blocking member 9 must of course in such case be adapted to the actual design. The switches 13 and 15 are preferably electrically connected to the driving motor, but it is also possible to use mechanically or hydraulically connected switches.

I claim:

1. Overrunning protection means for a grinding machine comprising a grinding wheel mounted in a head stock, means mounting the head stock on a machine frame for movement in a direction toward and away from a work rest for the work piece and drive means for rotating the grinding wheel including means for rotating the grinding wheel at a first angular velocity and a second lower angular velocity, the improvement comprising a blocking member operable between a first position permitting engagement of the drive means to rotate said grinding wheel at any angular velocity and a second position permitting engagement of said drive means to rotate said grinding wheel at said second lower velocity only, control means for selectively effecting actuation of said drive means including first sensing means for sensing the position of said blocking member, second sensing means for sensing the position of the head stock in relation to the grinding position of the work piece at said work rest and, means operatively connecting said first and second sensing means to said drive means to control the same in a predetermined manner so that said drive means is actuated only if said first sensing means senses said blocking member in said second position or if said second sensing means senses the head stock in a predetermined position relative to the work piece.

2. Overrunning protection means as claimed in claim 1 wherein said drive means includes a motor and cooperating belt and pulley means on the grinding wheel and motor drive shaft.

3. Overrunning protection means as claimed in claim 2 including a pair of pulleys of different diameter on the motor drive shaft.

4. Overrunning protection means as claimed in claim 1 wherein said drive means includes a motor and wherein said first sensing means includes first switch means electrically connected to said drive motor and said second sensing means includes second switch means electrically connected to said drive motor.

* * * * *